US012595716B1

(12) United States Patent
Villarreal

(10) Patent No.: US 12,595,716 B1
(45) Date of Patent: Apr. 7, 2026

(54) SINGLE SLEEVE DOWNHOLE TOOL WITH DETENT PINS FOR SHIFTING

(71) Applicant: Halliburton Energy Services, Inc., Houston, TX (US)

(72) Inventor: Frank Vinicia Acosta Villarreal, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/272,786

(22) Filed: Jul. 17, 2025

(51) Int. Cl.
*E21B 33/14* (2006.01)
*E21B 33/16* (2006.01)

(52) U.S. Cl.
CPC ..... *E21B 33/146* (2013.01); *E21B 33/16* (2013.01)

(58) Field of Classification Search
CPC ..... E21B 33/16; E21B 33/165; E21B 33/146
See application file for complete search history.

(56) References Cited

U.S. PATENT DOCUMENTS 6,206,094 B1 * 3/2001 Smith, Jr. ..... E21B 33/165 15/104.062
11,280,157 B2 3/2022 Acosta et al.
11,739,611 B2 8/2023 Acosta Villarreal et al.
2011/0203809 A1 * 8/2011 Knobloch, Jr. ..... E21B 34/142 166/334.1
2011/0253388 A1 * 10/2011 Willoughby ..... E21B 33/035 166/85.3
2016/0047183 A1 * 2/2016 Jekot ..... E21B 17/1007 166/85.5
2023/0127807 A1 * 4/2023 Jiral ..... E21B 34/142 166/316

* cited by examiner

*Primary Examiner* — David Carroll
(74) *Attorney, Agent, or Firm* — Sheri Higgins Law, PLLC; Sheri Higgins

(57) ABSTRACT

A downhole tool can include a body within a tubing string, a first component such as an outer mandrel, a detent pin connected to an inside of the first component, wherein the detent pin comprises a pin body and a spring located within the pin body, and a second component such as a sliding sleeve that moves in relation to the first component. The outside of the sliding sleeve includes a channel with a first stop, second stop, and optionally a third stop. When a pressure differential is applied to the tool, the spring can compress and the detent pin moves from the first stop to the second stop, which can open flow ports into a wellbore annulus. The detent pin can traverse again through the channel from the second stop to the third stop, which can close the flow ports.

20 Claims, 6 Drawing Sheets

SINGLE SLEEVE DOWNHOLE TOOL WITH DETENT PINS FOR SHIFTING

TECHNICAL FIELD

The field relates to a downhole tool for oil or gas operations. The downhole tool includes a single sleeve and a detent pin that is used to shift or slide the sleeve.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
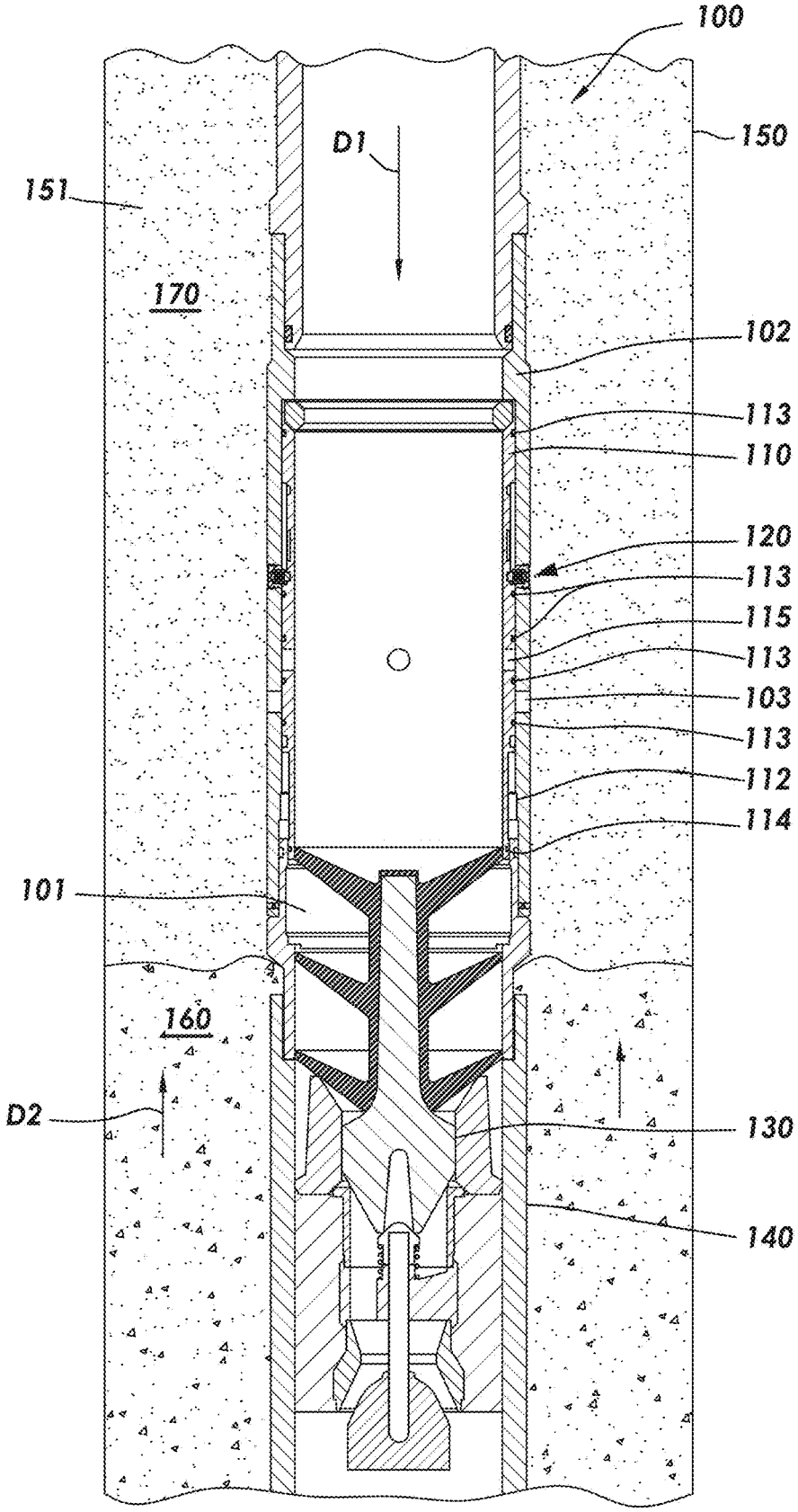
FIG. 1 illustrates an example downhole tool, such as a multi-stage cementer, during run in and a first stage cementing operation according to certain embodiments.

Oil and gas hydrocarbons are naturally occurring in some subterranean formations. In the oil and gas industry, a subterranean formation containing oil and/or gas is referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that can flow and conform to the outline of its container when the substance is tested at a temperature of 71° F. (22° C.) and at a pressure of one atmosphere "atm" (0.1 megapascals "MPa"). A fluid can be a liquid or gas. A homogenous fluid has only one phase; whereas a heterogeneous fluid has more than one distinct phase. A colloid is an example of a heterogeneous fluid. A heterogeneous fluid can be: a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase. As used herein, the term "base fluid" means the solvent of a solution or the continuous phase of a heterogeneous fluid and is the liquid that is in the greatest percentage by volume of a treatment fluid.

A well can include, without limitation, an oil, gas, or water production well, an injection well, or a geothermal well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

There are a variety of downhole tools that are used in oil and gas operations. Some downhole tools utilize one or more components that move in relation to another component, such as sleeves that shift or slide during the operation. One example of a downhole tool that utilizes a sliding sleeve is a cementing tool. The cementing tool can be a single-stage or multi-stage cementing tool. Another example of a downhole tool that utilizes a sliding sleeve is a cementing packer collar or a surge reduction tool.

A wellbore is formed using a drill bit. A drill string can be used to aid the drill bit in drilling into the subterranean formation to form the wellbore. The drill string can include a drilling pipe. During drilling operations, a drilling fluid, sometimes referred to as a drilling mud, may be circulated downwardly through the drilling pipe, and back up the annulus between the wellbore and the outside of the drilling pipe. The drilling fluid performs various functions, such as cooling the drill bit, maintaining the desired pressure in the well, and carrying drill cuttings upwardly through the annulus between the wellbore and the drilling pipe.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wall of a wellbore and the outside of a tubing string in an open-hole wellbore; the space between the wall of the wellbore and the outside of a casing in a cased-hole wellbore; and the space between the inside of a casing and the outside of a tubing string in a cased-hole wellbore.

During well completion, it is common to introduce a cement composition into an annulus in a wellbore. For example, in a cased-hole wellbore, a cement composition can be placed into and allowed to set in the annulus between the wellbore wall and the outside of the casing in order to stabilize and secure the casing in the wellbore. By cementing the casing in the wellbore, fluids are prevented from flowing into the annulus. Consequently, oil or gas can be produced in a controlled manner by directing the flow of oil or gas through the casing and into the wellhead. Cement compositions can also be used in primary or secondary cementing operations, well-plugging, or squeeze cementing.

As used herein, a "cement composition" is a mixture of at least cement and water. A cement composition can include additives. As used herein, the term "cement" means an initially dry substance that develops compressive strength or sets in the presence of water. Some examples of cements include, but are not limited to, Portland cements, gypsum cements, high alumina content cements, slag cements, high magnesia content cements, sorel cements, and combinations thereof. A cement composition is a heterogeneous fluid including water as the continuous phase of the slurry and the cement (and any other insoluble particles) as the dispersed phase. The continuous phase of a cement composition can include dissolved substances.

A spacer fluid can be introduced into the wellbore after the drilling fluid and before the cement composition. The spacer fluid can be circulated down through a drill string or tubing string and up through the annulus. The spacer fluid functions to remove the drilling fluid from the wellbore by pushing the drilling fluid through the casing and up into the annulus towards a wellhead.

A cement composition can then be introduced after the spacer fluid into the casing. There can be more than one stage of a cementing operation. Each stage of the cementing operation can include introducing a different cement composition that has different properties, such as density. A lead cement composition can be introduced in the first stage, while a tail cement slurry can be introduced in the second stage. Other cement compositions can be introduced in third, fourth, and so on stages. Cementing tools commonly include at least 2 sleeves-one to open flow ports into the annulus and the other to close the flow ports.

A cement composition should remain pumpable during introduction into a wellbore. A cement composition will ultimately set after placement into the wellbore. As used herein, the term "set," and all grammatical variations thereof, are intended to mean the process of becoming hard or solid by curing. As used herein, the "setting time" is the difference in time between when the cement and any other ingredients are added to the water and when the composition has set at a specified temperature. It can take up to 48 hours or longer for a cement composition to set. Some cement compositions can continue to develop compressive strength over the course of several days. The compressive strength of a cement composition can reach over 10,000 pounds force per square inch "psi" (69 MPa).

During first stage cementing operations, a first cement composition (e.g., a lead slurry) can be pumped from the wellhead, through the casing and the downhole tool, which can include a float shoe or collar, out the bottom of the casing, and into an annulus towards the wellhead. At the conclusion of the first stage, a shut-off plug can be placed into the casing, wherein the plug engages with a restriction near the bottom of the casing, such as a seat, and closes a fluid flow path through the casing.

After the casing has been shut off, an opening plug is typically dropped into the casing. This plug can engage with a seat that causes pressure to build up within the casing above this plug. When the pressure increases sufficiently, an opening sleeve of a cementing tool can shift downwardly to open flow ports that allow a fluid to flow from the inside of the casing into the annulus. Because the casing has been shut off from the shut-off plug, the opening plug cannot be pumped to the desired location in a fluid. Rather, the opening plug must be dropped into the casing where gravity carries the opening plug to the seat through the fluid. Not only does it take time for the opening plug to engage with the seat (oftentimes taking 2 or more hours), but it also prevents multi-stage cementing operations to be performed in horizontal wellbore portions.

After the flow ports have been opened via shifting of the opening sleeve, subsequent stages of the cementing operation can commence. Second-stage, third-stage etc. cement compositions can be pumped from the wellhead and through the inside of the casing. The cement composition(s) flow through the open flow ports and into the annulus.

When all stages of cementing have concluded, a closing plug can be pumped into the casing to engage with a seat on a closing sleeve of the cementing tool, thereby causing the closing sleeve to shift downwardly and close the flow ports. In order to restore fluid communication through the casing, the closing plug and seat, the opening plug and seat, and the shut-off plug and seat can be drilled or milled out.

There are several disadvantages to the current downhole tools that utilize one or more sliding sleeves. Firstly, having both an opening sleeve and a closing sleeve requires two seats, two plugs, and necessitates a longer tool body to accommodate both sleeves and a longer travel distance for shifting. A longer tool body is inherently more expensive. Secondly, costs are increased in both materials and time for seating an opening plug to open flow ports. Thirdly, some sleeves are not capable of withstanding the pressure exerted on the sleeve when the casing that has been cemented is pressure tested. This means that the amount of pressure that is needed to properly pressure test the casing may not be possible due to an increased risk of the sleeve failing. Thus, the pressure limitation may result in inadequate testing of the casing. Lastly, multi-stage cementing in horizontal wellbore portions may not be possible because there is no way to land the opening plug. Thus, there is a need for improved downhole tools that utilize a sliding sleeve that overcomes the aforementioned problems.

A downhole tool can include: a body configured to fit within a tubing string located in a wellbore; a first component located around an outside of at least a portion of the body; a detent pin connected to an inside of the first component, wherein the detent pin comprises a pin body and a spring located within the pin body; and a second component located within the body and inside a portion of the first component, wherein the second component is moveable in relation to the first component, wherein a portion of an outside of the second component comprises a channel, wherein the channel comprises a first stop and a second stop, and wherein the detent pin is configured to traverse within the channel from the first stop to the second stop when a pressure differential is applied to the second component.

Methods of performing an oil or gas operation in a wellbore can include: introducing a tubing string and the downhole tool installed within the tubing string into the wellbore; and applying a pressure differential to the second component, wherein the application of the pressure differential causes the second component to move in relation to the first component and causes the detent pin to traverse within the channel from the first stop to the second stop.

It is to be understood that the discussion of any of the embodiments regarding the downhole tool is intended to apply to all of the method and apparatus embodiments without the need to repeat the various embodiments throughout. Any reference to the unit "gallons" means U.S. gallons.

Figure 2:
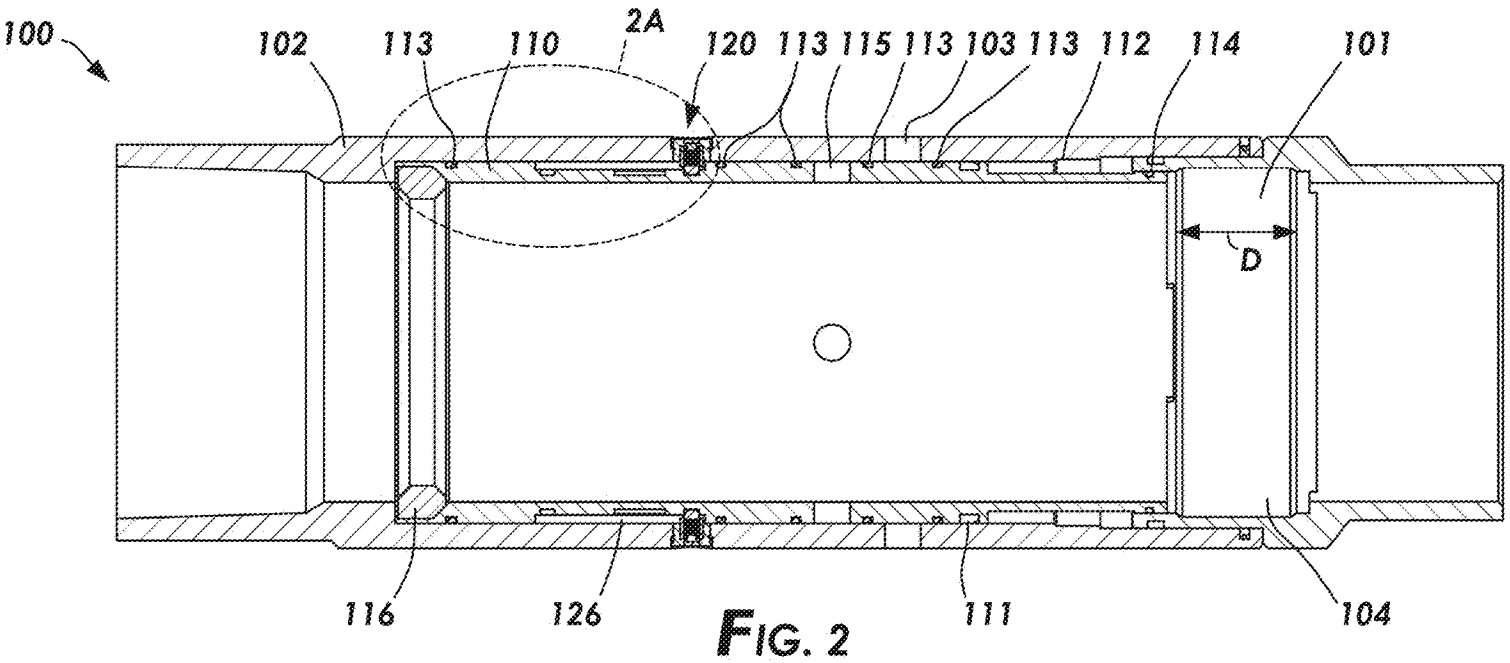
FIG. 2 is a cross-sectional view of the tool of FIG. 1 showing a single sleeve and detent pins.
Figure 2A:
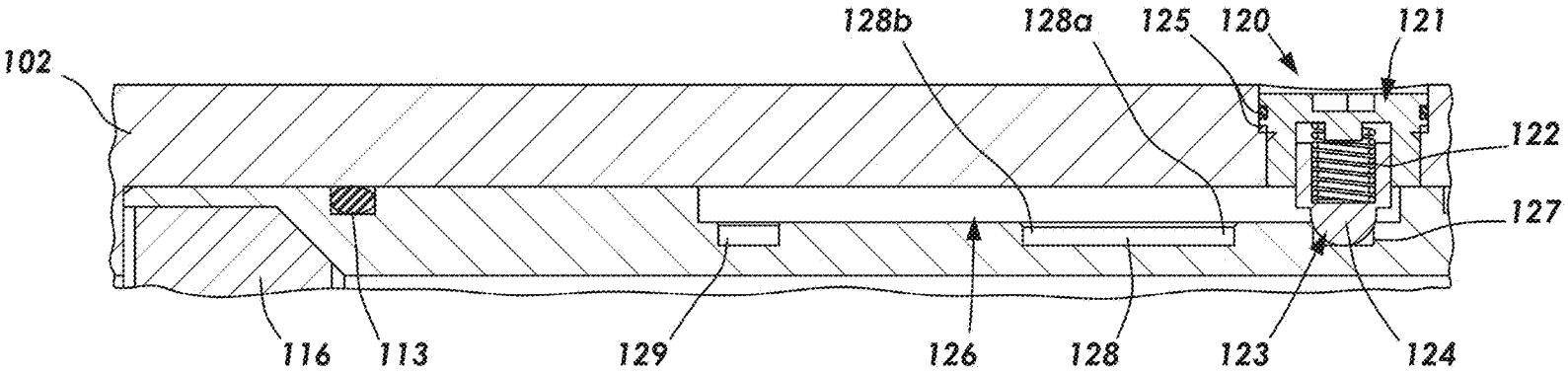
FIG. 2A is an enlarged, cross-sectional view of the detent pin and channel of FIG. 2.

Turning to the figures, FIGS. 1, 2, and 2A illustrate the downhole tool 100 during introduction into a wellbore—commonly known in the industry as being run in. The downhole tool 100 can be any tool that includes at least one component that is moveable in relation to another component. While the various embodiments may pertain to a "cementing tool" or "multi-stage cementing tool", it is to be understood that the various embodiments can be applied to any downhole tool that has one component that is moveable in relation to another component without the need to repeat the various tools individually. The downhole tool can also be a cementing packer collar or a surge reduction tool, for example.

The tool 100 includes a body 101. The body 101 can be configured to fit within a tubing string 140, for example, via casing box X pin connectors. The tubing string 140 and the tool 100 can be introduced into a wellbore that is defined by a wellbore wall 150. The tubing string 140 can be a casing string, wherein an annulus 151 is defined as the space located between the wellbore wall 150 and the outside of the casing string 140 and body 101 in an open-hole wellbore. For a cased wellbore, an annulus 151 can be defined as the space located between the inside of a casing string (which can be labeled 150 as a substitution for the wellbore wall) and the outside of the tubing string 140 and body 101.

The tool 100 includes a first component 102 located around an outside of at least a portion of the body 101. The first component 102 can be, for example, an outer mandrel as shown. It is to be understood that any discussion regarding the outer mandrel 102 is with reference to the first component and is meant to include other components of the tool 100 besides an outer mandrel. The tool 100 also includes a second component 110 located within the body 101 and inside a portion of the first component 102, wherein the second component 110 is moveable in relation to the first component 102. The second component 110 can be any type of component that is capable of moving in a direction relative to the first component 102. The second component 110 can be a sliding sleeve 110 that is moveable in relation to the outer mandrel 102, for example as shown in the figures. It is to be understood that any discussion regarding the sliding sleeve 110 is with reference to the second component and is meant to include other components of the tool 100 besides sliding sleeve.

With reference to FIG. 1, during the oil or gas operation (e.g., a first stage cementing operation), a first fluid 160 (e.g., a lead cement slurry) can be introduced into the wellbore, for example by being pumped from a wellhead, flow through an inside of the tubing string 140 and the tool 100 in direction D1, exit a bottom end of the tubing string, and flow upwardly through the annulus 151 towards the wellhead in direction D2. As used herein, the relative term "bottom" is provided for reference and means at a location farther away from a wellhead. The term "bottom" is not meant to limit the context to a vertical arrangement but can be interpreted for horizontal wellbore portions wherein the "bottom" may be to the right or left of the orientation reference. The first fluid is prevented from flowing through the flow ports 103, 115 because the ports are not aligned with each other in an open position. The first fluid 160 can displace another fluid 170 (e.g., a drilling mud or spacer fluid) in a bottom portion of the annulus 151.

The tool 100 also includes one or more detent pins 120 connected to an inside of the outer mandrel 102, shown in enlarged detail in FIG. 2A. The detent pins 120 include a pin body 123 and a spring 122 located within a bushing 121 and the pin body. The bushing 121 can include, for example, a hexagonal head, that is used to connect the detent pins 120 to the inside of the outer mandrel 102. The pin body 123 can include a tapered end 124 that has an outer diameter (O.D.) that is less than the O.D. of the rest of the pin body and narrows in a direction towards the inside of the sliding sleeve 110. One or more scaling elements 125, for example O-rings, can be located around the outside of the bushing 121. The sealing elements 125 prevent fluid from entering the detent pins 120 and contacting the spring 122. The total number of detent pins 120 that are used can vary, for example in a range of 2-10 and can be dependent on the pressure rating of the tool 100 and/or the pressure required to compress the springs 122 (as will be discussed in more detail below).

The tool 100 also includes a channel 126 located on a portion of an outside of the sliding sleeve 110. The channel 126 can be an elongated groove formed along a portion of the outside of the sliding sleeve 110. The channel 126 can have a length in a range of 6 to 24 inches (15.2 to 60.96 centimeters "cm"), a width in a range of 2 to 12 inches (5.1 to 30.48 cm), and a depth in a range of 1 to 8 inches (2.5 to 20.3 cm). According to any of the embodiments, the bushing 121 has dimensions that are greater than the channel's 126 width. In this manner, the bushing 121 remains outside and on top of the channel 126 during movement of the sliding sleeve 110 and the pin body 123 can traverse within the channel 126. According to any of the embodiments, the depth of the channel 126 is selected such that when the springs 122 of the detent pins 120 are compressed, the detent pins 120 can traverse within the channel 126 during shifting of the sliding sleeve 110. By way of example, if the depth of the channel 126 is too shallow, then when the spring 122 is compressed, the tapered end 124 may not have enough clearance to move within the channel 126 from a first stop 127 to a second stop 128.

With continued reference to FIGS. 1, 2, and 2A, the tool 100 can also include one or more sealing elements 113 (e.g., O-rings) located circumferentially around the outside of the sliding sleeve 110 that seal against the inside of the outer mandrel 102. There can also be an inner sealing element 114 that seals against the inside of the sliding sleeve 110.

The tool 100 includes at least one outer flow port 103. The outer flow port 103 is defined by an opening that traverses through a portion of the outer mandrel 102. The sliding sleeve 110 also has an inner flow port 115 that traverses through a portion of the sliding sleeve 110. The openings of the flow ports 103, 115 can be a variety of dimensions and shapes. By way of an example, the diameter of the opening can range from 1 in. to 10 in (2.54 to 25.4 cm). The diameter of the opening can be selected, in part, based on the desired fluid volume and/or flow rate of a fluid through the flow ports 103, 115. The opening can be any shape, for example, circular, square, rectangular, or other geometric shapes. There can also be multiple flow ports 103, 115 located in a variety of spacing distances from each other. Preferably, the dimensions and shape of the outer flow port 103 and the inner flow port 115 are the same.

The flow ports 103, 115 are for fluid communication with an inside of the tubing string 140 and the annulus 151 of the wellbore as described above. The flow ports 103, 115 can be oriented on the outer mandrel 102 and the sliding sleeve 110 such that a fluid (e.g., a cement composition) can flow through the flow ports 103, 115 in a direction that is transverse to a longitudinal axis of the tubing string 140 and into the annulus 151 when the ports are open.

After the first fluid 160, such as a cement composition, is introduced into the annulus 151 through the bottom of the casing or tubing string, it may be desirable to perform another oil and gas operation through the tool 100. As can be seen in FIG. 1, a shutoff plug 130 can be pumped or dropped into the tubing or casing string 140, wherein the shutoff plug 130 engages with a restriction near the bottom of the tubing or casing string, such as a seat, and closes a fluid flow path through the tubing or casing string. The tool 100 can be hydraulically activated to open the flow ports 103, 115. A pressure differential can be applied to the tool 100 in an area located between the inner sealing element 114 and the sealing element 113 located next to a closing seat 116. The detent pins 120 are energized by the spring 122 into a naturally expanded position away from the inside of the outer mandrel 102. The spring force of the spring 122 can be used to determine the amount of pressure differential required to open the flow ports 103, 115 and can be calculated as the area between the sealing elements and the pressure. By way of example, if the total spring force of the detent pins 120 is 2,000 pounds force "lbr", then the area can be used to calculate the pressure needed to reach 2,000 psi. The pressure increases until it equals or exceeds the spring force of the detent pins 120. Once the pressure differential reaches the minimum pressure needed, then the spring 122 in the detent pins 120 is compressed and moves the tapered end 124 of the detent pins 120 up and out of engagement with the first stop 127. As used herein, the phrases "sits within" and "engagement with" and all grammatical variations thereof means that at least the tapered end of the pin body is located within the channel and the first, second, and optional third stops and remains within the stops until a pressure differential greater than or equal to the force rating of the spring(s) is reached—and does not mean that the detent pin is capable of traversing between the stops on its own and if the pressure differential is less than the force rating of the spring(s).

The detent pin 120 or multiple detent pins 120 can be selected based on the force rating of the detent pins, the total number of detent pins used, and the predetermined amount of force needed to disengage the tapered end 124 from the first stop 127 and the second stop 128. For example, if the total force required to compress the spring 122 is 3,000 pounds force "lbr" and each spring has a rating of 1,000 lbf, then a total of three detent pins 120 may be used. The force rating of the springs 122 can vary and be selected based on the tubing or casing string 140 weight and material grade among other factors. According to any of the embodiments, the force rating of the springs 122 of the detent pins 120 is less than 80% of the force rating of the tubing string 140. By contrast, the force rating of the springs 122 can be a minimum force rating such that premature compression of the springs 122 that disengages the tapered end 124 from the first stop 127 and second stop 128 does not occur.

Figure 3:
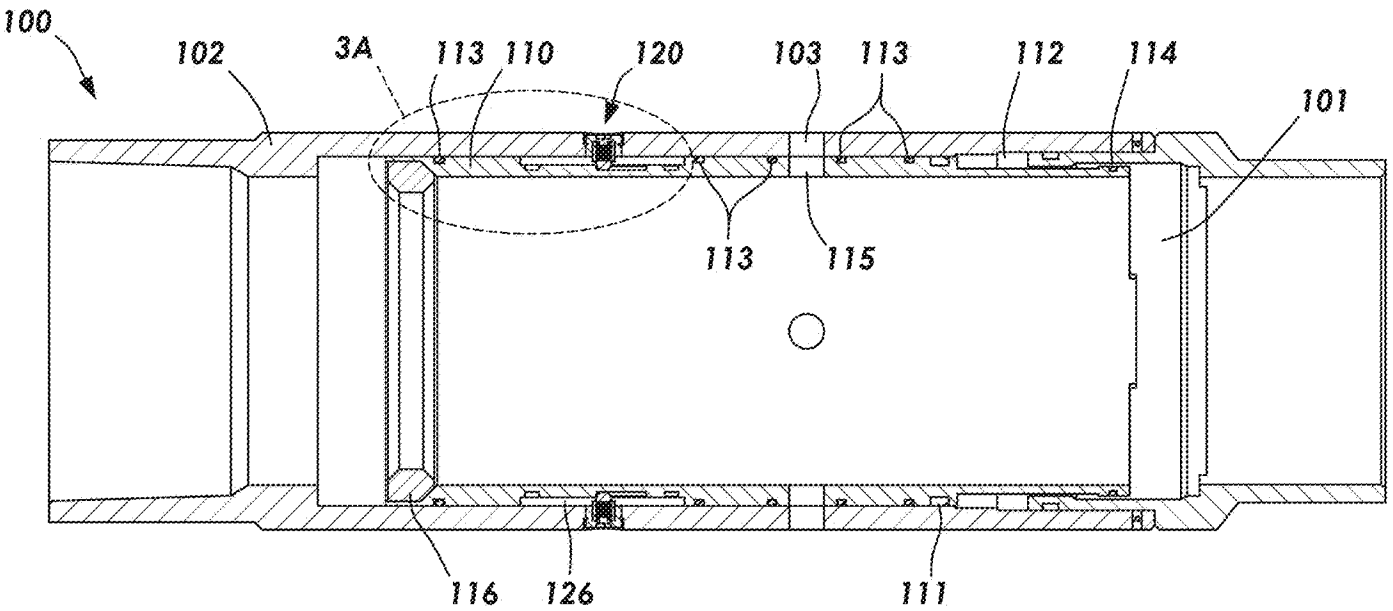
FIG. 3 is a cross-sectional view of the downhole tool in an open position after the sleeve has shifted down to open flow ports and shows the detent pin traversing from a first stop to a second stop according to certain embodiments.
Figure 3A:
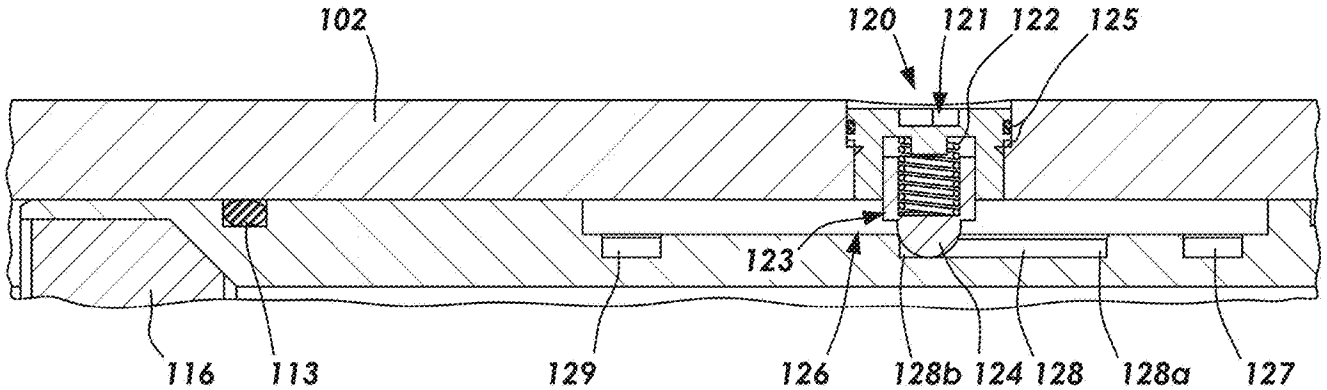
FIG. 3A is an enlarged, cross-sectional view of the detent pin and channel of FIG. 3.

FIGS. 3 and 3A show the tool 100 when the flow ports 103, 115 are in an open position. The first stop 127 can be circular, square, hexagonal, octagonal, etc. in shape and have a perimeter and a depth such that all or a portion of the tapered end 124 of the detent pins 120 sits within and engages with the first stop 127 when the spring 122 is in the energized, expanded position. The tapered end 124 can have the same shape as the first stop 127. By way of example, the perimeter of the first stop 127 can be greater than the OD of the tapered end 124; thus, ensuring that the tapered end 124 can fully sit within and engage with the first stop 127 and does not prematurely disengage with the first stop. The second stop 128 can be a groove that has a width and a depth such that the tapered end 124 of the detent pins 120 can sit within and engage with the second stop 128 like the discussion pertaining to the first stop 127. The second stop 128 groove can include a first end 128*a* and a second end 128*b*. The distance between the first stop 127 and the first end 128*a* of the second stop 128 can be selected such that the sliding sleeve 110 shifts downward to begin to open the flow ports 103, 115 with the spring 122 in the retracted position, and can be in a range of 0.25 to 0.5 inches (0.64 to 1.27 cm), for example.

As can be seen, when the spring 122 of the detent pins 120 is compressed by the pressure differential, the tapered end 124 disengages with the first stop 127 as the spring 122 is retracted. The sliding sleeve 110 then shifts downward in relation to the outer mandrel 102 and the detent pins 120 traverses within the channel 126 from the first stop 127 towards the second stop 128. As the flow ports 103, 115 begin to align, the pressure differential begins to decrease for 2 reasons. First, as the flow ports 103, 115 begin to align, some of the fluid being pumped through the tool 100 can now flow through the partially aligned flow ports 103, 115 and into the annulus 151. Second, as the sliding sleeve 110 moves downward, the inner scaling element 114 also moves with the sliding sleeve 110 and can enter an undercut 104 of the outer mandrel 102 that is located a distance D (e.g., 4-6 inches (10.2 to 15.2 cm)) down from the inner sealing element 114 when the tool 100 is in the run-in position as shown in FIG. 2 and lose its sealing capability. Preferably, the distance D is selected such that the pressure differential is maintained until the tapered end 124 of the detent pins 120 is able to completely disengage with the first stop 127 and allow the sliding sleeve 110 to shift downward. When the inner sealing element 114 enters the undercut 104, the seal it created is lost. The loss of the seal can occur very close to or simultaneously with the retraction of the spring 122 and disengagement of the tapered end 124 with the first stop 127. However, gravity will cause the sliding sleeve 110 to continue to shift downward. For applications in a horizontal wellbore (i.e., a wellbore that has a longitudinal axis that is angled away from a vertical orientation and where a plug cannot be dropped to engage with a seat via gravity but has to be pumped) the outer mandrel 102 does not include the undercut 104. This is so the inner scaling element 114 can maintain the seal and maintain the necessary pressure differential to shift the sliding sleeve 110 to align the flow ports 103, 115 in the open position.

When the first end 128*a* of the second stop 128 aligns with the tapered end 124 of the detent pins 120 as the sliding sleeve 110 moves downward, the spring 122 will naturally return to the expanded position due to the decrease in pressure and the tapered end 124 will then engage with and sit within the second stop 128. The inner flow port 115 of the sliding sleeve 110 continues to move towards the outer flow port 103 of the outer mandrel 102. With continued movement of the sliding sleeve 110, the tapered end 124 of the detent pins 120 can traverse from the first end 128*a* to the second end 128*b* of the second stop 128. The length between the first end 128*a* and the second end 128*b* of the second stop 128 can be selected such that when the tapered end 124 of the detent pins 120 reaches the second end 128*b*, the flow ports 103, 115 are completely aligned and in the open position. By way of example, if there is a distance of 10 inches between the center of the inner flow port 115 and the center of the outer flow port 103 when the tool 100 is in the run-in position, then the length of the groove of the second stop 128 and thus, the distance between the first end 128*a* and the second end 128*b* can be 10 inches. In this manner, when the tapered end 124 has completely traversed from the first end 128*a* to the second end 128*b*, the sliding sleeve 110 will be prevented from shifting further down and the flow ports 103, 115 will be completely aligned in a fully open position.

Figure 4:
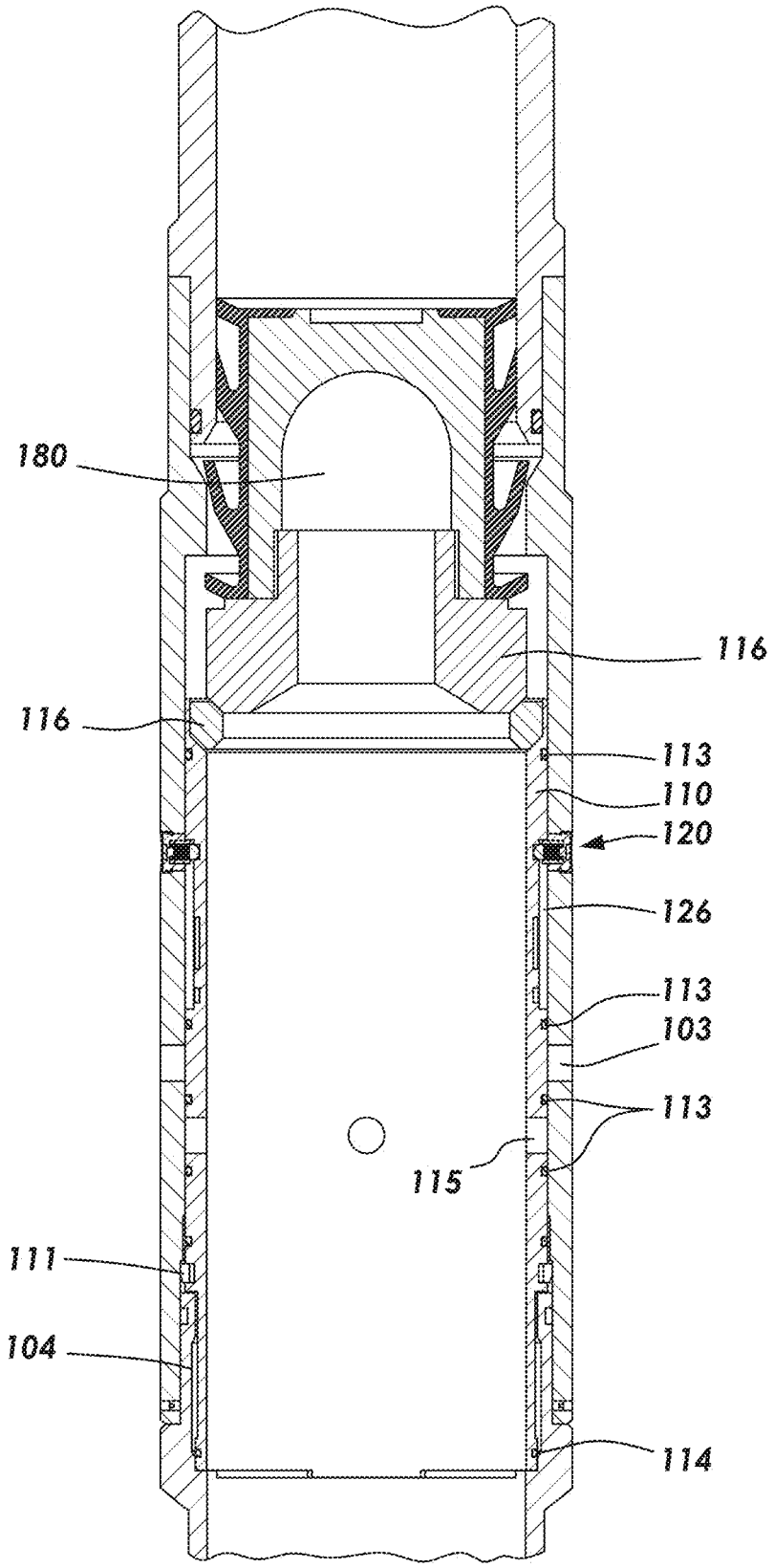
FIG. 4 illustrates the downhole tool in a closed position with a closing plug.
Figure 5:
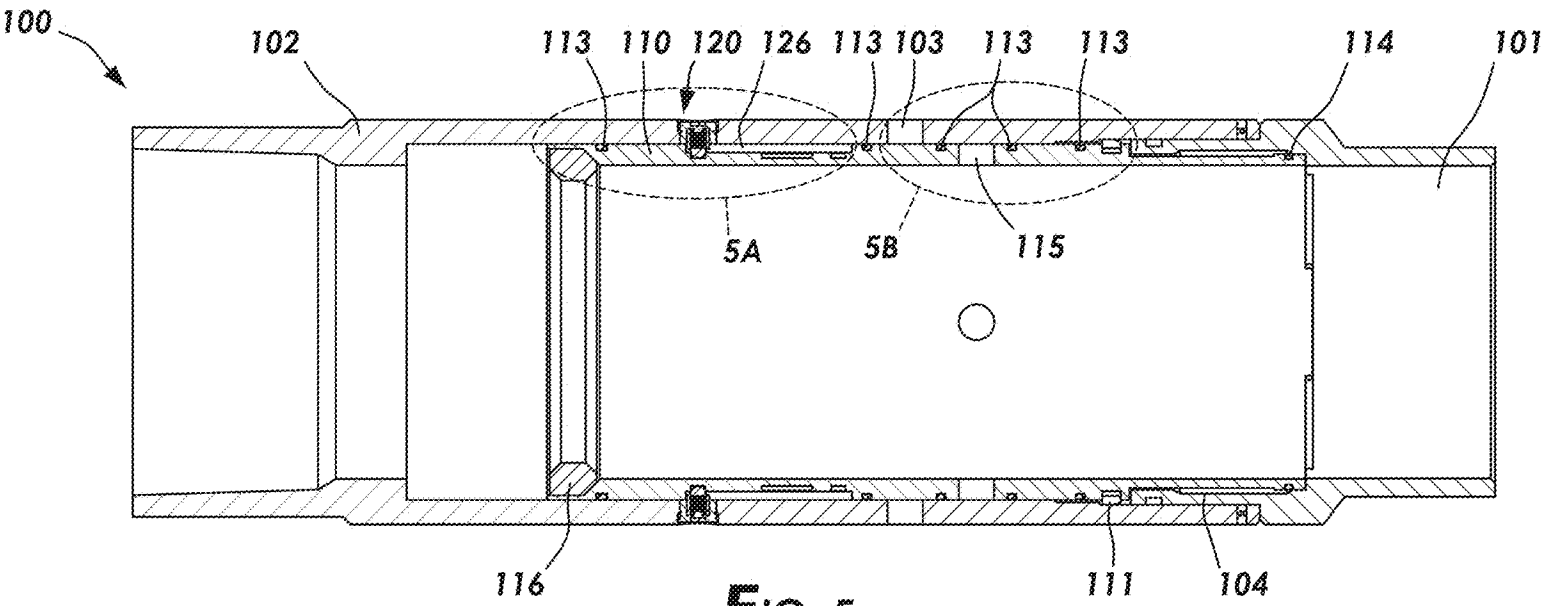
FIG. 5 is a cross-sectional view of the downhole tool in the closed position after the sleeve has shifted down to close flow ports and shows the detent pin traversing from the second stop to a third stop according to certain embodiments.
Figure 5A:
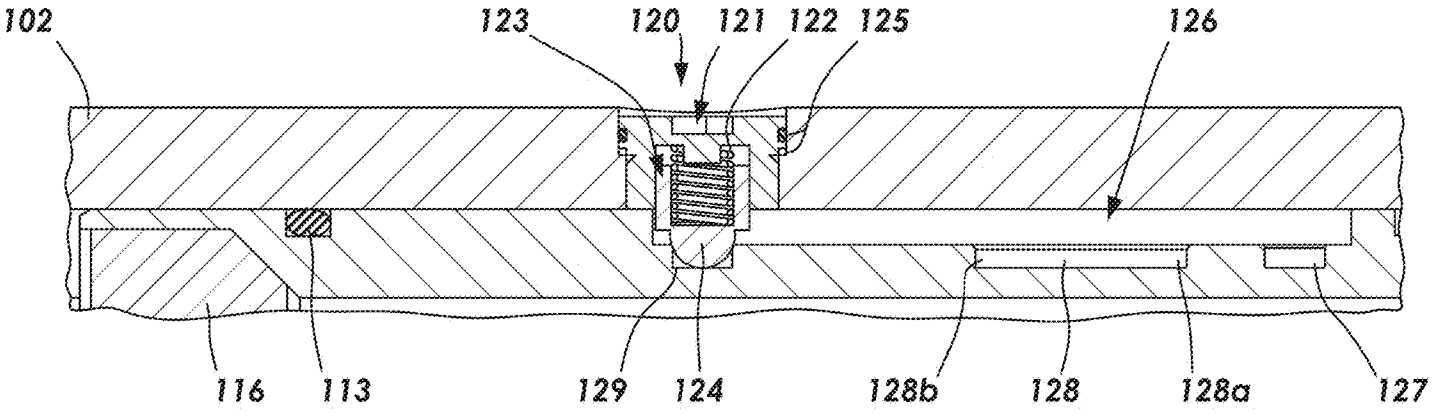
FIG. 5A is an enlarged, cross-sectional view of the detent pin and channel of FIG. 5.
Figure 5B:
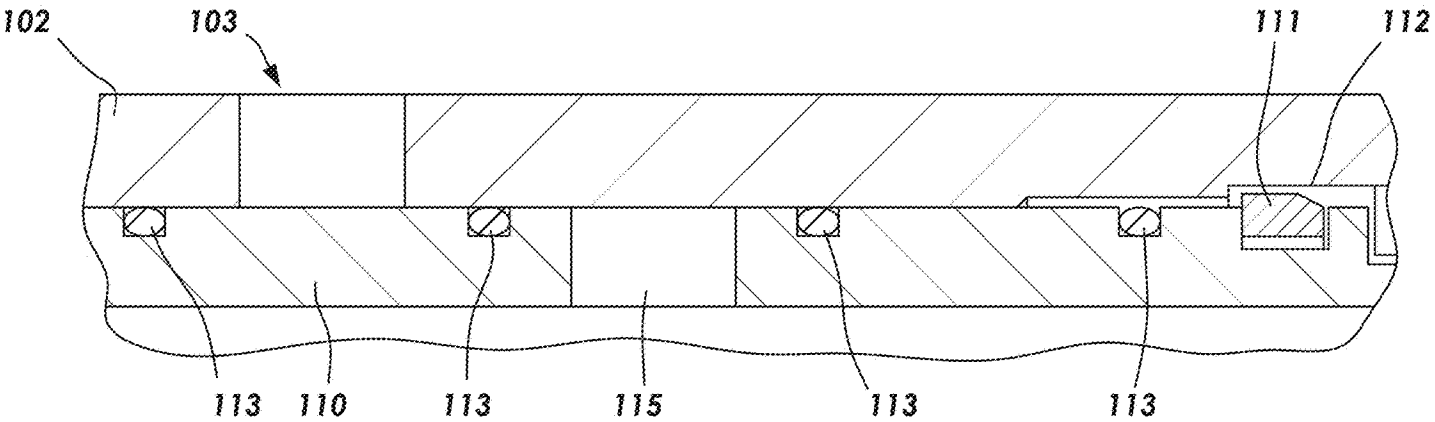
FIG. 5B is an enlarged, cross-sectional view of a lock ring and lock ring groove of FIG. 5.

The methods can include introducing a second fluid, such as a tail cement composition or other fluid, into the annulus 151 via the open flow ports 103, 115. The second fluid can be pumped, for example, from the wellhead and into the annulus 151. Additional fluids for subsequent stages can be introduced after the second fluid. Once the volume of the second fluid or any additional fluids are pumped into the annulus, the flow ports 103, 115 can be closed, as shown in FIGS. 4-5B. The methods can include closing the fluid flow path through the flow ports 103, 115. The sliding sleeve 110 can include a closing seat 116. A closing plug 180 can be pumped into the tool 100. The closing plug 180 can engage with the closing seat 116 and create a seal, thereby blocking fluid flow past the closing seat 116. Pressure can then be increased within the tubing string 140 above the closing seat 116. When the pressure in the tubing string 140 reaches or exceeds the force rating of the springs 122 of the detent pins 120, the springs 122 can once again compress and disengage with the second end 128*b* of the second stop 128. Once the detent pins 120 have disengaged with the second stop 128, the sliding sleeve 110 can then shift down in relation to the outer mandrel 102.

The detent pins 120 can then traverse through the channel 126 from the second stop 128 to a third stop 129. The third stop 129 can be the same as or similar to the first stop 127, for example having the same shape, dimensions, and depth. According to any of the embodiments, the depth of the third stop 129 is greater than (deeper) than the depth of the second stop 128 and first stop 127. When the detent pins 120 align with the third stop 129, the spring 122 will naturally expand back towards the outside of the sliding sleeve 110 and the tapered end 124 will move into and engage with the third stop 129. The distance between the second end 128*b* of the second stop 128 and the third stop 129 can be selected such that the inner flow port 115 of the sliding sleeve 110 moves completely past the outer flow port 103 of the outer mandrel 102 to completely close the flow ports to fluid communication into the annulus. Continued downward travel of the sliding sleeve 110 can be prevented by engagement of the detent pins 120 within the third stop 129 and the greater depth of the third stop, which keeps the flow ports 103, 115 closed to fluid communication into the annulus. As shown in FIG. 5B, a lock ring 111 can be located around the outside of the sliding sleeve 110 and engage with a lock ring groove 112 located on the inside of the outer mandrel 102 to lock the sliding sleeve 110 in the closed position; thus, also preventing further downward travel.

Figure 6:
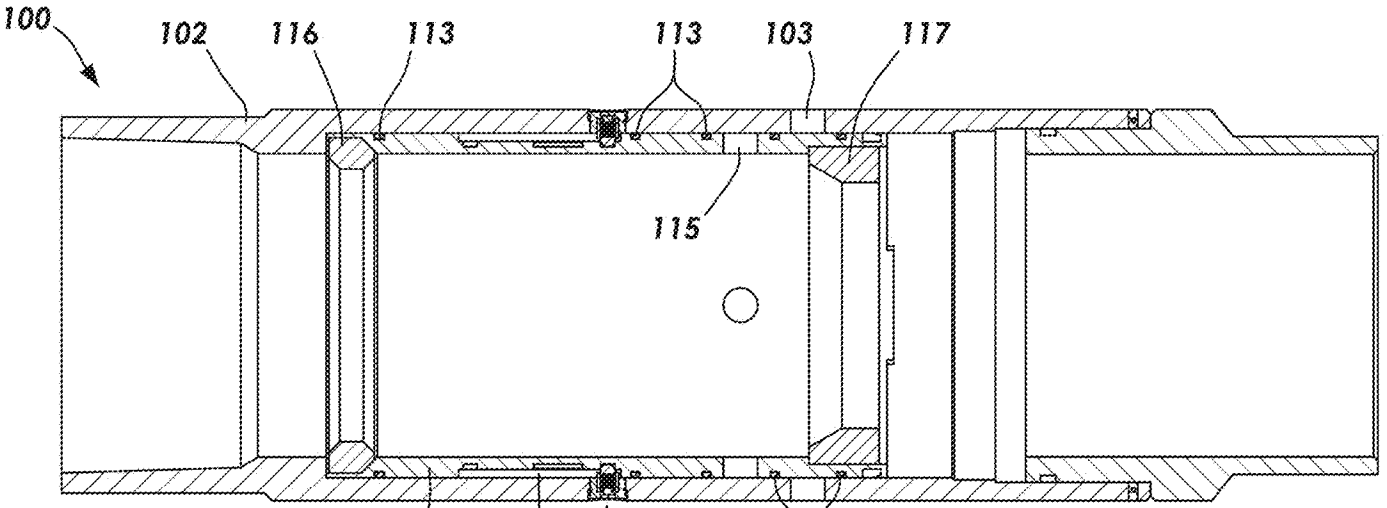
FIG. 6 is a cross-sectional view of the downhole tool further comprising an opening seat instead of an inner sealing element and undercut according to certain other embodiments.

According to certain other embodiments, the tool 100 can further include an opening seat 117 as shown in FIG. 6. According to these embodiments, the inner sealing element 114 and undercut 104 shown in the other Figures are not needed because the opening seat is used to create the pressure differential. The pressure differential required to cause the detent pins 120 to traverse within the channel 126 from the first stop 127 to the second stop 128 and then optionally to the third stop 129 can be created by dropping an opening plug, such as a ball or dart, through the tool 100 to land on the opening seat 117. The requisite pressure builds up within the sliding sleeve 110 to cause the spring 122 to retract as discussed above. These embodiments are useful in vertical wellbores where the opening plug can be dropped, and gravity moves the plug into scaling engagement with the opening seat 117.

According to any of the embodiments, the tool 100 does not include a frangible device. Typically, frangible devices, such as shear pins, shear to allow shifting of the sliding sleeve or to allow one tool component to move in relation to another tool component. However, frangible devices are not needed nor are included because the detent pins allow the sleeve to be shifted.

Any of the tool 100 components can be made from a variety of materials. Examples of suitable materials include, but are not limited to, metals, metal alloys, composite materials, dissolvable materials, phenolics, rubber, or hardened plastics. The closing seat 116 and the optional opening seat 117 can be made from a drillable material.

The methods include introducing a tubing string 140 and the downhole tool 100 installed within the tubing string into the wellbore. The methods can include introducing a first fluid 160 into the wellbore through the tubing string 140. As discussed above, the first fluid 160 can flow up into the annulus 151 and displace a predetermined volume of fluid 170. The methods can include closing a fluid flow path through a bottom end of the tubing string 140. Referring to FIG. 1, the fluid flow path can be closed by dropping or pumping the shut-off plug 130 into the tubing string 140. The tubing string 140 can include a shut-off seat (not labeled) that is located below the tool 100. The shut-off plug 130 can engage with the shut-off seat and shut off fluid flow past the shut-off plug 130.

The methods also include applying a pressure differential to the second component (e.g., the sliding sleeve 110), wherein the application of the pressure differential causes the second component to move in relation to the first component (e.g., the outer mandrel 102) and causes the detent pin(s) 120 to traverse within the channel 126 from the first stop 127 to the second stop 128, which opens the flow ports 103, 115. The methods can also include introducing a second fluid into the annulus via the open flow ports. The methods can further include applying a pressure differential to the second component, wherein the application of the pressure differential causes the second component to once again move in relation to the first component and causes the detent pins 120 to traverse within the channel 126 from the second stop 128 to the third stop 129, which closes the flow ports 103, 115.

It may be desirable to restore fluid communication through the tubing string 140, for example, after a cement composition has set in the annulus 151. A drilling or milling device can be used to remove all components, such as the closing plug 180, closing seat 116 and the optional opening seat 117, and the shut-off plug 130, that prevent fluid flow through the tubing string 140. The methods can further include restoring fluid communication through the tubing string.

Some of the many unique advantages to the downhole tool that uses detent pins include that the single sleeve can be made of steel that can withstand high differential pressures by design. This eliminates pressure limitations to test the casing after closing. The downhole tool eliminates the inconveniences that sometimes occur when a hydraulic tool and an inflation packer need to be set with high pressures. Furthermore, the downhole tool can be made out of five main components—namely an upper body, a single sleeve, the detent pins, a closing seat, and a lower sub, which makes the tool easy to manufacture and assemble and allows any API or premium connections to be installed. Another advantage is there is less drill-out material than most other tools on the market, which provides a faster drill out and produces a full, big bore after drill out.

An embodiment of the present disclosure is a downhole tool comprising: a body configured to fit within a tubing string located in a wellbore; a first component located around an outside of at least a portion of the body; a detent pin connected to an inside of the first component, wherein the detent pin comprises a pin body, a bushing, and a spring located within the bushing and the pin body; and a second component located within the body and inside a portion of the first component, wherein the second component is moveable in relation to the first component, wherein a portion of an outside of the second component comprises a channel, wherein the channel comprises a first stop and a second stop, and wherein the detent pin traverses within the channel from the first stop to the second stop when a pressure differential is applied to the second component. Optionally, the first component is an outer mandrel, and the second component is a sliding sleeve, and wherein the sliding sleeve is moveable in relation to the outer mandrel. Optionally, the downhole tool is a multi-stage cementing tool. Optionally, the detent pin further comprises a bushing that connects the detent pin to the inside of the first component. Optionally, the pin body comprises a tapered end that has an outer diameter that is less than an outer diameter of a top portion of the pin body and narrows in a direction towards an inside of the second component. Optionally, the detent pin further comprises one or more scaling elements located around the outside of the bushing. Optionally, the channel has a depth, and wherein the depth of the channel is selected such that when the spring of the detent pin is compressed, the detent pin traverses within the channel from the first stop to the second stop. Optionally, the channel has a width, and wherein the bushing has dimensions that are greater than the width of the channel. Optionally, the tool further comprises one or more scaling elements located circumferentially around the outside of the second component that seal against the inside of the first component, and an inner sealing element that seals against the inside of the second component. Optionally, the first component comprises an undercut located adjacent to the inner sealing element, and wherein the inner sealing element enters the undercut when the detent pin traverses from the first stop to the second stop. Optionally, the second stop is a groove having a width and a depth such that a tapered end of the detent pin sits within and engages with the second stop. Optionally, the tool further comprises at least one outer flow port defined by an opening that traverses through a portion of the first component, and at least one inner flow port defined by an opening that traverses through a portion of the second component. Optionally, the second stop comprises a first end and a second end, and wherein when the detent pin traverses from the first end to the second end the outer and inner flow ports are in an open position that allows fluid communication through the open flow ports. Optionally, the spring has a spring force, and wherein when the pressure differential applied to the second component equals or exceeds the spring force, then the spring is compressed and moves a tapered end of the detent pin up and out of engagement with the first stop. Optionally, the channel further comprises a third stop, wherein the second stop is located between the first stop and the third stop, wherein the detent pin traverses within the channel from the second stop to the third stop when a pressure differential is applied to the second component. Optionally, the pressure differential is applied via a closing seat and a closing plug, and when the detent pin traverses from the second stop to the third stop, an outer flow port and an inner flow port are in a closed position that prevents fluid communication through the closed flow ports. Optionally, the tool further comprises an opening seat, and wherein the pressure differential applied for the detent pin to traverse from the first stop to the second stop is applied via the opening seat and an opening plug.

Another embodiment of the present disclosure is a method of performing an oil or gas operation in a wellbore comprising: introducing a tubing string and a downhole tool installed within the tubing string into the wellbore, wherein the downhole tool comprises: a body configured to fit within the tubing string; a first component located around an outside of at least a portion of the body; a detent pin connected to an inside of the first component, wherein the detent pin comprises a pin body, a bushing, and a spring located within the bushing and the pin body; and a second component located within the body and inside a portion of the first component, wherein a portion of an outside of the second component comprises a channel, wherein the channel comprises a first stop and a second stop; and applying a pressure differential to the second component, wherein the application of the pressure differential causes the second component to move in relation to the first component and causes the detent pin to traverse within the channel from the first stop to the second stop. Optionally, the first component is an outer mandrel, and the second component is a sliding sleeve, and wherein the sliding sleeve is moveable in relation to the outer mandrel. Optionally, the downhole tool is a multi-stage cementing tool. Optionally, the detent pin further comprises a bushing that connects the detent pin to the inside of the first component. Optionally, the pin body comprises a tapered end that has an outer diameter that is less than an outer diameter of a top portion of the pin body and narrows in a direction towards an inside of the second component. Optionally, the detent pin further comprises one or more sealing elements located around the outside of the bushing. Optionally, the channel has a depth, and wherein the depth of the channel is selected such that when the spring of the detent pin is compressed, the detent pin traverses within the channel from the first stop to the second stop. Optionally, the channel has a width, and wherein the bushing has dimensions that are greater than the width of the channel. Optionally, the tool further comprises one or more sealing elements located circumferentially around the outside of the second component that seal against the inside of the first component, and an inner sealing element that seals against the inside of the second component. Optionally, the first component comprises an undercut located adjacent to the inner sealing element, and wherein the inner scaling element enters the undercut when the detent pin traverses from the first stop to the second stop. Optionally, the second stop is a groove having a width and a depth such that a tapered end of the detent pin sits within and engages with the second stop. Optionally, the tool further comprises at least one outer flow port defined by an opening that traverses through a portion of the first component, and at least one inner flow port defined by an opening that traverses through a portion of the second component. Optionally, the second stop comprises a first end and a second end, and wherein when the detent pin traverses from the first end to the second end the outer and inner flow ports are in an open position that allows fluid communication through the open flow ports. Optionally, the spring has a spring force, and wherein when the pressure differential applied to the second component equals or exceeds the spring force, then the spring is compressed and moves a tapered end of the detent pin up and out of engagement with the first stop. Optionally, the channel further comprises a third stop, wherein the second stop is located between the first stop and the third stop, wherein the detent pin traverses within the channel from the second stop to the third stop when a pressure differential is applied to the second component. Optionally, the pressure differential is applied via a closing seat and a closing plug, and when the detent pin traverses from the second stop to the third stop, an outer flow port and an inner flow port are in a closed position that prevents fluid communication through the closed flow ports. Optionally, the tool further comprises an opening seat, and wherein the pressure differential applied for the detent pin to traverse from the first stop to the second stop is applied via the opening seat and an opening plug.

Therefore, the apparatus, methods, and systems of the present disclosure are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present disclosure.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more tool components, detent pins, stops, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A downhole tool comprising:

a body configured to fit within a tubing string located in a wellbore;

a first component located around an outside of at least a portion of the body;

a detent pin connected to an inside of the first component, wherein the detent pin comprises a pin body, a bushing, and a spring located within the bushing and the pin body; and a second component located within the body and inside a portion of the first component, wherein the second component is moveable in relation to the first component, wherein a portion of an outside of the second component comprises a channel, wherein the channel comprises a first stop and a second stop, wherein the first stop and the second stop have a depth that is greater than a depth of the channel as measured from an inner diameter of the first component, and wherein the detent pin traverses within the channel from the first stop to the second stop when a pressure differential is applied to the second component.

2. The downhole tool according to claim 1, wherein the first component is an outer mandrel, and the second component is a sliding sleeve, and wherein the sliding sleeve is moveable in relation to the outer mandrel.

3. The downhole tool according to claim 1, wherein the downhole tool is a multi-stage cementing tool.

4. The downhole tool according to claim 1, wherein the bushing connects the detent pin to the inside of the first component.

5. The downhole tool according to claim 1, wherein the pin body comprises a tapered end that has an outer diameter that is less than an outer diameter of a top portion of the pin body and narrows in a direction towards an inside of the second component.

6. The downhole tool according to claim 1, wherein the detent pin further comprises one or more sealing elements located around the outside of the bushing.

7. The downhole tool according to claim 1, wherein the depth of the channel is selected such that when the spring of the detent pin is compressed, the detent pin traverses within the channel from the first stop to the second stop.

8. The downhole tool according to claim 1, wherein the channel has a width, and wherein the bushing has dimensions that are greater than the width of the channel.

9. The downhole tool according to claim 1, further comprising one or more sealing elements located circumferentially around the outside of the second component that seal against the inside of the first component, and an inner sealing element that seals against the inside of the second component.

10. The downhole tool according to claim 9, wherein the first component comprises an undercut located adjacent to the inner sealing element, and wherein the inner sealing element enters the undercut when the detent pin traverses from the first stop to the second stop.

11. The downhole tool according to claim 1, wherein the second stop is a groove having a width and a depth such that a tapered end of the detent pin sits within and engages with the second stop.

12. The downhole tool according to claim 1, further comprising at least one outer flow port defined by an opening that traverses through a portion of the first component, and at least one inner flow port defined by an opening that traverses through a portion of the second component.

13. The downhole tool according to claim 12, wherein the second stop comprises a first end and a second end, and wherein when the detent pin traverses from the first end to the second end the outer and inner flow ports are in an open position that allows fluid communication through the open flow ports.

14. The downhole tool according to claim 1, wherein the spring has a spring force, and wherein when the pressure differential applied to the second component equals or exceeds the spring force, then the spring is compressed and moves a tapered end of the detent pin up and out of engagement with the first stop.

15. The downhole tool according to claim 1, wherein the channel further comprises a third stop, wherein the second stop is located between the first stop and the third stop, wherein the detent pin traverses within the channel from the second stop to the third stop when a pressure differential is applied to the second component.

16. The downhole tool according to claim 15, wherein the pressure differential is applied via a closing seat and a closing plug, and when the detent pin traverses from the second stop to the third stop, an outer flow port and an inner flow port are in a closed position that prevents fluid communication through the closed flow ports.

17. The downhole tool according to claim 1, further comprising an opening seat, and wherein the pressure differential applied for the detent pin to traverse from the first stop to the second stop is applied via the opening seat and an opening plug.

18. A method of performing an oil or gas operation in a wellbore comprising:

introducing a tubing string and a downhole tool installed within the tubing string into the wellbore, wherein the downhole tool comprises:

a body configured to fit within the tubing string;

a first component located around an outside of at least a portion of the body;

a detent pin connected to an inside of the first component, wherein the detent pin comprises a pin body, a bushing, and a spring located within the bushing and the pin body; and a second component located within the body and inside a portion of the first component, wherein a portion of an outside of the second component comprises a channel, wherein the channel comprises a first stop and a second stop, wherein the first stop and the second stop have a depth that is greater than a depth of the channel as measured from an inner diameter of the first component; and applying a pressure differential to the second component, wherein the application of the pressure differential causes the second component to move in relation to the first component and causes the detent pin to traverse within the channel from the first stop to the second stop.

19. The method according to claim 18, wherein when the detent pin traverses from the first stop to the second stop an outer flow port and an inner flow port align with each other in an open position that allows fluid communication through the open flow ports.

20. The method according to claim 18, wherein the channel further comprises a third stop, wherein the second stop is located between the first stop and the third stop, wherein the detent pin traverses within the channel from the second stop to the third stop when a pressure differential is applied to the second component.

* * * * *